US005923204A

United States Patent [19]

Rapeli et al.

[11] Patent Number: 5,923,204

[45] Date of Patent: Jul. 13, 1999

[54] TWO PHASE LOW ENERGY SIGNAL PROCESSING USING CHARGE TRANSFER CAPACITANCE

[75] Inventors: Juha Rapeli, Oulu, Finland; José De Albuquerque Epifânio Da Franca; Carlos Mexia De Almeida De Azeredo Leme, both of Lisbon, Portugal; João Paulo Zuna Bello, Sacavem, Portugal; Pedro António De Sousa Cardoso Lopes, Almada, Portugal; Ricardo Dos Santos Reis, Amadora, Portugal

[73] Assignee: Nokia Mobile Phones Limited, Espoo, Finland

[21] Appl. No.: 08/965,544

[22] Filed: Nov. 6, 1997

[30] Foreign Application Priority Data

Nov. 8, 1996 [FI] Finland ..... 964497

[51] Int. Cl.[6] ..... G06G 7/18

[52] U.S. Cl. ..... 327/337; 327/554

[58] Field of Search ..... 327/337, 336, 327/554, 536, 537, 589

[56] References Cited

U.S. PATENT DOCUMENTS

| | | | |
|---|---|---|---|
| 5,216,291 | 6/1993 | Seevinck et al. | 327/535 |
| 5,289,059 | 2/1994 | Pikkarainen | 327/552 |
| 5,365,119 | 11/1994 | Kivari | 327/115 |
| 5,387,874 | 2/1995 | Rapeli | 327/337 |
| 5,390,223 | 2/1995 | Lindholm | 377/49 |
| 5,416,435 | 5/1995 | Jokinen et al. | 327/113 |
| 5,497,116 | 3/1996 | Rapeli | 327/337 |
| 5,581,776 | 12/1996 | Hagqvist et al. | 395/590 |
| 5,712,777 | 1/1998 | Nicollini et al. | 363/59 |
| 5,754,417 | 5/1998 | Nicollini | 327/536 |

FOREIGN PATENT DOCUMENTS

| | | |
|---|---|---|
| 0039076 A1 | 4/1981 | European Pat. Off. . |
| 0412609 A3 | 2/1991 | European Pat. Off. . |
| 0621550 A3 | 10/1994 | European Pat. Off. . |
| 0747849 A1 | 12/1996 | European Pat. Off. . |

*Primary Examiner*—Tim Callahan
*Assistant Examiner*—Terry L. Englund
*Attorney, Agent, or Firm*—Perman & Green, LLP

[57] ABSTRACT

A charge transfer from signal voltage ($U_S$) to integrating capacitance ($C_O$) is accomplished by means of charge transfer capacitance ($C_i$), an active element (T) and controllable switches ($S_{61}$, $S_{62}$, $S_{63}$, $S_{64}$). The operation of the circuit is additionally based on the fact that the charge transfer to the charge transfer capacitance ($C_i$) is terminated when the transistor (T) is in a current-carrying state and that current flow is ensured by a constant-current element set. These features are combined preferably in such a way that the breaking current of charge transfer is equally great as previously said current of the constant-current element.

13 Claims, 3 Drawing Sheets

TWO PHASE LOW ENERGY SIGNAL PROCESSING USING CHARGE TRANSFER CAPACITANCE

BACKGROUND OF THE INVENTION

The object of the invention is an improved method and circuit arrangement for processing a signal. The invention can preferably be used in processing analog signals in embodiments where it is essential to achieve small energy consumption. By the term signal processing one means, in this context, for example, the summing, difference, integration and differentiation of voltage representing a signal, or charge or current equally well.

The processing of analog signals is often connected with the problem of how to achieve small energy consumption since continuous current consumption of linearly operating active analog circuits such as, for example, operational amplifiers, is extremely high.

Basic methods are prior known in which signal samples can be processed, substituting for structures which consume continuously current, by processing a signal by means of a switching transistor transferring exclusively charge impulses. Methods of this kind have been described in patent specifications Fl 89838 (corresponds to specifications EP 473436 and U.S. Pat. No. 5,387,874) and FI 931831 (corresponds to specifications EP 621 550 and U.S. Pat. No. 5,497,116).

In U.S. Pat. No. 5,387,874, an integrating circuit has been described wherein storing of sample charges taken from signal voltage to a sampling capacitor and further discharge of sample charges from the sampling capacitor to an integrating capacitor are controlled by means of switches. A similar arrangement can also be used for implementing signal processing elements other than the integrator. The described circuit consumes current essentially only when charges are being transferred. One disadvantage of such an arrangement is, however, that for the positive and negative cycles of the signal voltage, one requires separate switching arrangements and separate clock phases controlling the switches, and this complicates the circuit. In addition, the use of separate circuit parts for processing the negative and the positive cycle of a signal may cause signal distortions due to threshold voltages and differences between the components.

Disadvantages of the above mentioned circuit can be avoided by using the solution described in U.S. Pat. No. 5,497,116. In the following, the operation of the circuit arrangement presented in the specification concerned is described in greater detail to make it easier to understand the operation and advantages of the present invention compared to the prior art.

FIG. 1 shows a signal processing circuit which has been implemented by means of transistors T1 and T2 and in which there is a time discrete integral of the voltage ($U_S$-$U_{Ref}$) as a final result. An MOS transistor of an N type, i.e. an N-MOS transistor has been used as transistors T1, T2. Switches $S_{21}$–$S_{30}$ of the circuit shown in FIG. 1 are controlled by clock signals 1–4. The clock signals 1–4 control the switches in four successive phases so that, for example, during the clock cycle1, the clock signal controls those switches into a conducting state which are controlled by the clock signal 1. In the following, the switches are indicated by means of the letter S and indexes so that the subindex refers to the number of the switch which is numbered consecutively, and the superscript refers to those clock phases during which the switch is in a conducting state. For example, the indication $S_{21}^{1,3}$ indicates that the switch 21 is in a conducting state during clock phases 1 and 3 and is controlled by clock signals 1 and 3. During the other clock phases, 2 and 4, said switch is in a non-conducting state. Correspondingly, the voltage indication described with a superscript indicates voltage which is present during the clock phase indicated by the superscript, and the charge indication equipped with a superscript indicates charge which is present or is being transferred during the clock phase indicated by the superscript. Accordingly, for example, $U_{Ci}^2$ indicates the voltage U of the capacitance $C_i$ during/at the end of the clock phase 2. Clock pulses are so-called non-overlapping clock pulses which means that during a certain phase, only the switches which are meant to be closed during that phase are in a conducting state and the other switches are open.

The operation of clock phases 1–4 of the connection is shown in detail in FIGS. 2–5 in which only the necessary elements with respect to the operation of each clock phase are presented for the circuit according to FIG. 1. The signs (polarity, e.g. positive or negative) of signals and voltages are indicated in relation with the ground potential.

FIG. 2 shows the operation during clock phase 1. For the clock phase 1, switches $S_{21}$, $S_{22}$, $S_{23}$ and $S_{24}$ are closed, during which a charge transferring capacitor $C_i$, which herein is also called a sampling capacitor $C_i$, is charged to a voltage $U_{Ci}^1$:

$$U_{Ci}^1=U_S^1+U_{Ref}+U_{th1} \quad (1)$$

in which $U_{th1}$ is a threshold voltage of the gate/source voltage of a transistor T1. When the gain of the transistor T1 is great, the charge being transferred to the sampling capacitor $C_i$ is taken essentially from the supply voltage VDD of the circuit and not from the signal voltage $U_S$.

The operation in the subsequent clock phase 2 is illustrated in FIG. 3. During the clock phase 2, switches $S_{26}$, $S_{27}$ and $S_{28}$ are in a conducting state (closed) during which a sampling capacitor $C_i$ forms a gate/source voltage to a transistor T2 enabling current flow from the positive supply voltage VDD to an integrating capacitor $C_O$. The current flow continues until the sampling capacitor $C_i$ has become discharged to a threshold voltage $U_{th2}$ of the gate/source junction of the transistor T2 at which time the current flow stops. Thus charge becomes transferred from the sampling capacitor $C_i$ to the integrating capacitor $C_O$ until the voltage of the capacitor $C_i$ has reduced to the value $U_{th2}$. Then, during the clock phase 2, a charge $$\Delta Q^2=C_i(U_S+U_{Ref}-U_{th1}-U_{th2}) \quad (2)$$

has become transferred from the charge transferring capacitor $C_i$ to the integrating capacitor $C_O$.

FIG. 4 illustrates the operation of the circuit during clock phase 3 when the switches $S_{21}$, $S_{23}$, $S_{24}$ and $S_{25}$ are closed. Then the sampling capacitor $C_i$ is connected via the transistor T1 to the reference voltage $U_{ref}$ at which the capacitor is charged to the voltage $$U_{Ci}^3=U_{Ref}-U_{th1} \quad (3)$$

FIG. 5 illustrates the operation of the circuit during the final clock phase 4 when the switches $S_{26}$, $S_{29}$ and $S_{30}$ are closed. Then the sampling capacitor $C_i$ forms a gate/source voltage to the transistor T2 enabling current flow through the sampling capacitor $C_i$ from the integrating capacitor $C_O$ to a lower supply voltage VSS. Current flow continues until the sampling capacitor $C_i$ has become discharged to a threshold voltage $U_{th2}$ of the gate/source junction of the transistor T2. Then, the amount of negative charge which has become transferred to the integrating capacitor $C_O$ equals:

$$\Delta Q^4 = -C_i(U_{Ref} - U_{th1} - U_{th2}) \quad (4)$$

When the gain of the transistor T2 is high, as is the case when a good quality bipolar transistor is concerned, or almost infinite such as the gain of a field-effect transistor (for example, an MOS transistor), also in transfer phases of a charge, the transferring charge taken from the supply voltage (VDD, VSS) is essentially as high as required for the transfer of a desired charge from a sampling capacitance $C_i$ to an integrating capacitance $C_O$. During all clock phases 1–4, the charge having become transferred to the output of the connection which is taken from the integrating capacitor $C_O$, is the sum of the equations (2) and (4), in other words $$\Delta Q_{tot} = C_i(U_S + U_{Ref} - U_{Ref}) = C_i U_S \quad (5)$$

Correspondingly, during one repetition phase Tr of the clock phases, that is, during clock phases 1–4, the voltage of the integrating capacitor $C_O$ changes its value by the amount indicated by the equation (6):

$$\Delta U_{C_O} = \frac{C_i}{C_O}(U_s + U_{\mathrm{Re}\,f} - U_{\mathrm{Re}\,f}) = \frac{C_i}{C_O} U_s \quad (6)$$

Thus, from a connection according to FIG. 1, a discrete time, positive integrating connection of a signal voltage is formed, and the weighting coefficient of its time integration is $C_i/C_O$. The sign of the integration can be changed to negative by changing the execution order of the above described clock phases 2 and 4 with each other, in which case the operation performed during clock phase 4 is carried out after phase 1 and the operation during clock phase 2 is performed after phase 3. In this case, also the signs of the above described equations (2) and (4) and thus also the signs of the equations (5) and (6) become changed (positive changes to negative and negative changes to positive). Based on this connection, many variations can easily be achieved according to what kind of transistors are used (NPN, PNP, N-MOS or P-MOS) and according to whether one wishes to implement the connection using only one transistor instead of two transistors (above T1 and T2).

The above presented solution according to the prior art leads to the result that after the charge has become transferred, the circuit is essentially currentless and the dependence on threshold voltages and non-linearities of circuit elements is minimal. When one implements a circuit according to the solution by CMOS transistors, the circuit has, however, three fundamental limitations. Firstly, a part of switching transistors are floating with voltages which are being processed, which leads in implementations to changes in a threshold voltage due to a so-called backgate phenomenon. This can be revealed as non-linearity in the operation of the circuit in such a way that when taking a sample and transferring a sample, the transistor may have different threshold voltages. In addition, with unequal signals, threshold voltages have values which differ from each other. Typically a transistor would float in an area of approximately one volt in which case the threshold voltage could fluctuate by some millivolts. That is the reason why it would be preferable to minimize potential fluctuations of the transistor when the implementation of the method is considered.

Secondly, in circuits according to prior known solutions a transistor becomes transferred to a currentless state so that the voltage of a gate falls to a threshold voltage. This occurs slowly since the gate voltage $V_{GS}$ of the transistor is modified by the charging of the capacitance $C_i$ and this charging again happens only through channel resistance which at the same time increases to approach an infinite value. Thus the switching may be slow and the increase in channel resistance also causes noise. However, in the implementation based on a bipolar transistor, said speed and noise properties are improved.

The third limitation connected to the prior art is that the implementation of more than two (for example, four) clock signals in different phases complicates the circuit. Particularly in implementations which are integrated for silicon, the wiring of four clock signals in different phases demands a considerably greater area than that required for wiring of two clock phases, although the number of switches would not be significantly high. Thus it is preferable to strive to reduce the number of clock signals needed in different phases.

BRIEF SUMMARY OF THE INVENTION

The aim of the invention is to devise a method and an arrangement for processing a signal which exploit a basic method according to the prior art referred to previously to achieve these advantages of the method but in such a manner, based on an inventive solution, that the above presented disadvantages connected to the prior art can be avoided.

The desired improvements in the operation of the circuit are achieved in a manner presented in this invention so that charge transfer of a transistor to a capacitance $C_i$ stops when the transistor is in a current-carrying state and that current flow is ensured by means of a constant-current element which has been arranged according to the invention. According to the invention, these features are combined preferably in such a way that the breaking current of the charge transfer equals the above mentioned current in the constant-current element.

A method according to the invention wherein a charge transfer capacitance is switched to an operational connection with a signal, the charge of the charge transfer capacitance is changed by a charge amount which is proportional to the instantaneous value of a signal being processed during the time when the charge transfer capacitance is in an operational connection with the signal, the charge transfer capacitance is switched to an operational connection with an integrating capacitance, charge is transferred between a sampling capacitance and said integrating capacitance during the time when the charge transfer capacitance is in an operational connection with the integrating capacitance and the charge of said charge transfer capacitance is changed by current formed by an active element connected to the charge transfer capacitance and this current has been arranged to be dependent on the voltage of said charge transfer capacitance, is characterized in that charge is transferred between said charge transfer capacitance and said integrating capacitance by means of the difference between the currents of an active element and a constant-current element connected in series with it in such a way that said difference current flows essentially through the charge transfer capacitance, changing its charge by the amount proportional to the instantaneous value of the signal.

A circuit arrangement according to the invention which comprises a charge transfer capacitance, at least one active element, first switching elements for switching the charge transfer capacitance into an operational connection with a signal for changing the charge of said charge transfer capacitance by a charge amount which is proportional to the instantaneous value of the signal.

an integrating capacitance, second switching elements for switching the charge transfer capacitance into an operational connection with the integrating capacitance for transferring a charge between the charge transfer capacitance and the integrating capacitance, at least one active element for changing the charge of the charge transfer capacitance depending on the voltage of said charge transfer capacitance, is characterized in that it comprises additionally a constant-current element for changing the charge of the charge transfer capacitance in which case said active element and said constant-current element have been inserted into the circuit in series so that the difference between the currents they form is transferred essentially through the charge transfer capacitance changing its charge by the amount which is proportional to the instantaneous value of the signal.

Preferable embodiments of the invention have been presented in dependent claims.

BRIEF DESCRIPTION OF THE DRAWING

The invention is described in the following in more detail by referring to the attached drawings wherein.

DETAILED DESCRIPTION OF THE INVENTION

Figure 1:
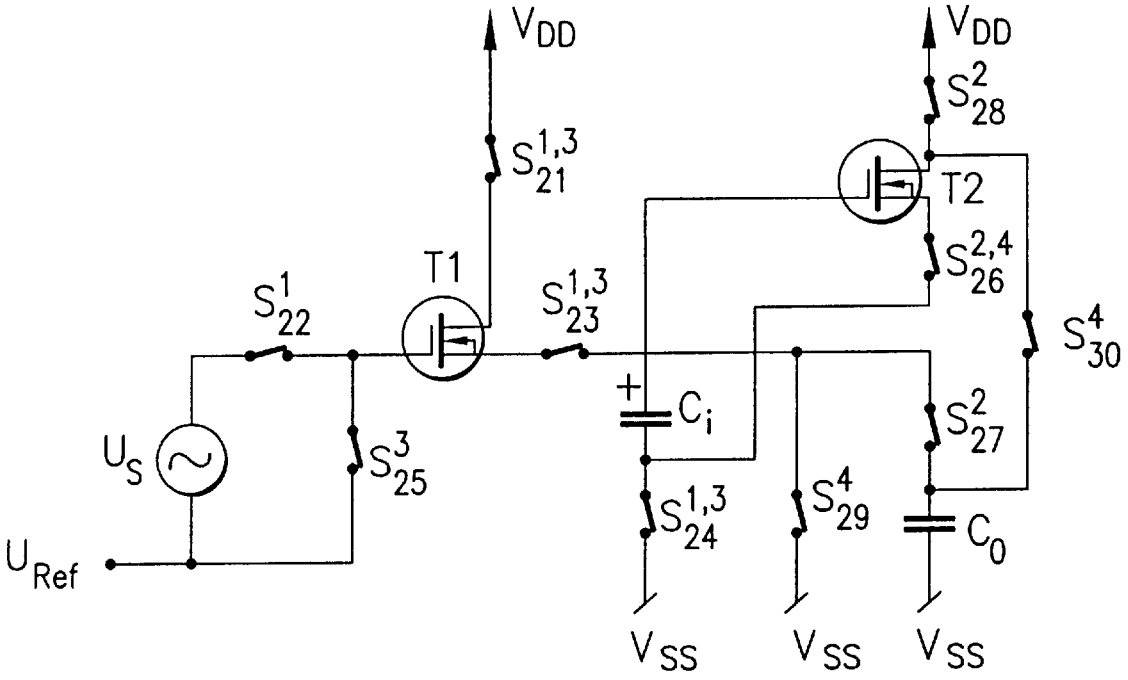
FIG.1 PRIOR ART
FIG. 1 shows an integrating circuit in its entirety according to the prior art.
Figure 2:
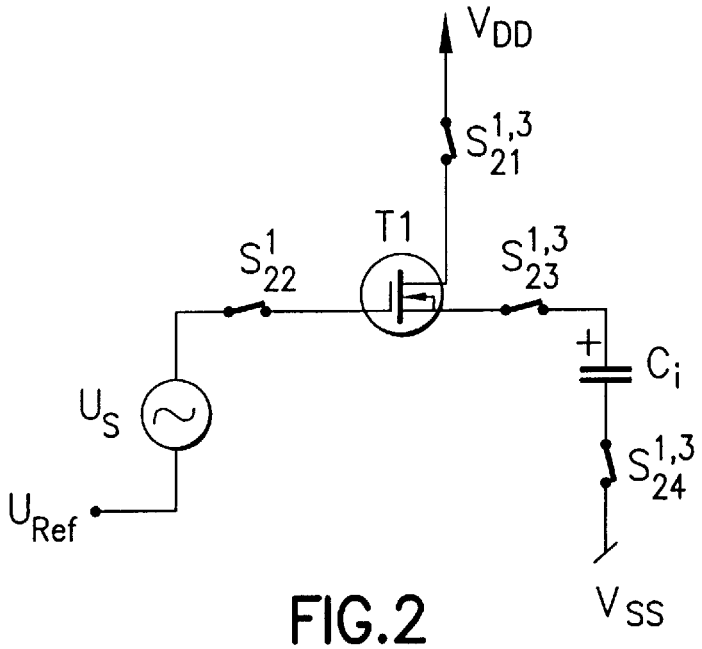
FIG.2 PRIOR ART
FIG. 2 shows schematically the essential parts connected to the operation during clock phases 1 of the switching arrangement of FIG. 1.
Figure 3:
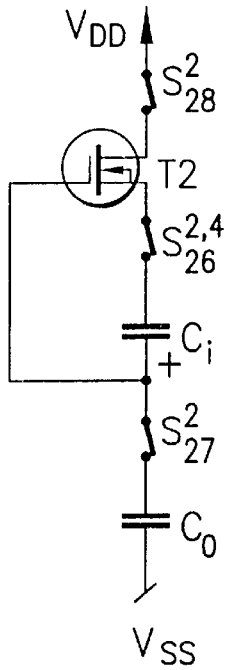
FIG.3 PRIOR ART
FIG. 3 shows schematically the essential parts connected to the operation during clock phase 2 of the switching arrangement of FIG. 1.
Figure 4:
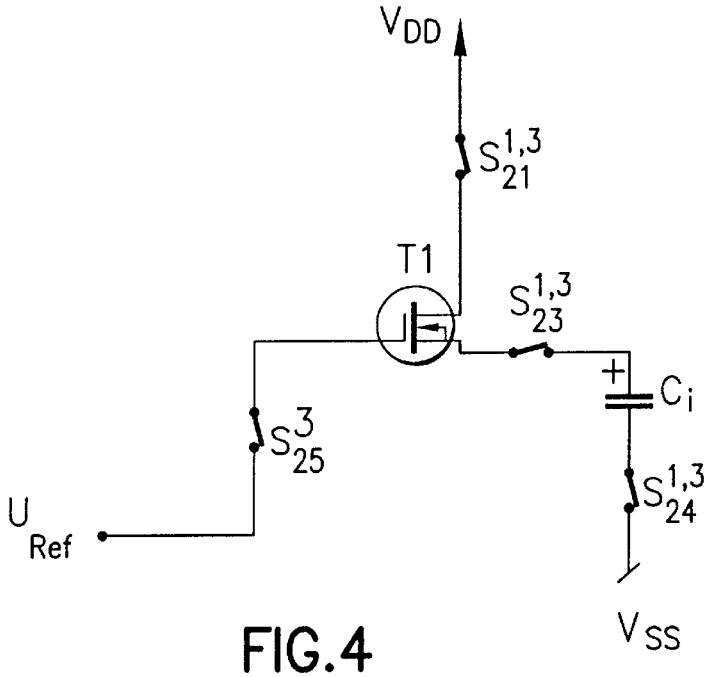
FIG.4 PRIOR ART
FIG. 4 shows schematically the essential parts connected to the operation during clock phase 3 of the switching arrangement of FIG. 1.
Figure 5:
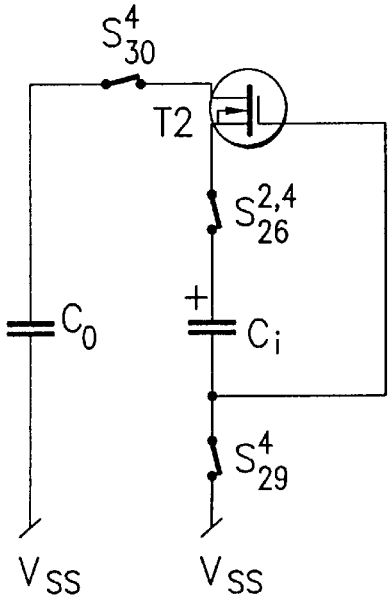
FIG.5 PRIOR ART
FIG. 5 shows schematically the essential parts connected to the operation during clock phase 4 of the switching arrangement of FIG. 1.

Solutions according to the prior art were described previously by means of FIGS. 1–5. In the following, a solution according to the invention is described in more detail, and this solution has been shown in FIG. 6. The operation of the circuit arrangement comprises two clock phases according to which switches $S_{61}$–$S_{64}$ in the circuit are controlled. Clock signals 1 and 2 control the switches in two successive phases so that during clock phase 1, the clock signal 1 controls those switches ($S_{61}$, $S_{63}$) into a conducting state which are controlled by the clock signal 1. Similarly, during clock phase 2 the clock signal 2 controls those switches ($S_{62}$, $S_{64}$) into a conducting state which are controlled by the clock signal 2. To illustrate the operation of the circuit arrangement, essential parts connected to the operation during each clock phase have been separately shown in FIGS. 7 and 8. As a superscript of switches and voltages, numbers indicating the clock phases of the circuit arrangement have been used in the following in a way previously defined in the context of the description of the prior art.

Figure 6:
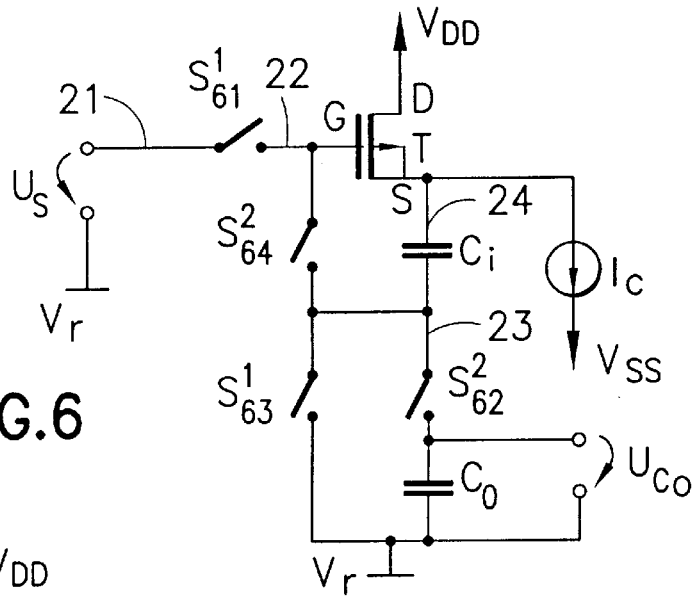
FIG. 6 shows a circuit solution according to the invention.

Circuit arrangement according to FIG. 6 is described in the following by using as an example a p-channel transistor T, the threshold voltage of which is $V_T$. The magnitude of the threshold voltage $V_T$ is typically around −0.5 V. Current equations describing the operation of a p-channel transistor are in the essential area with respect to the operation of the connection as follows:

$$I_D=\tfrac{1}{2}k(V_{GS}-V_T)^2 \tag{7}$$

$$I_D=kV_{DS}(V_{GS}-V_T) \tag{8}$$

The constant-current element $I_c$ used in the circuit forms essentially the constant current $I_c$. The operation of the connection is however studied first without the constant-current element $I_c$. During clock phase 1 (FIG. 7) the gate G of the transistor T is switched by a switch $S_{61}^1$ to a signal voltage $U_S$ and the first electrode 23 of the capacitance $C_i$ by a switch $S_{63}^1$ to a constant potential $V_r$. The second electrode 24 of the charge transfer capacitance $C_i$ has been connected in a fixed manner to the sources of the transistor T. Thus the capacitance $C_i$ becomes charged to the voltage $$U_{Ci}^1=U_S-V_T \tag{9}$$

It is assumed at first that $U_S<0$ and at which time the voltage $U_{Ci}$ of the charge transfer capacitance has a greater absolute value than the threshold voltage $V_T$ of the transistor.

During clock phase 2 (FIG. 8) the integrating capacitance $C_O$ is connected in series with the charge transfer capacitance $C_i$ by a switch $S_{62}^2$ and at the same time, the voltage $U_{Ci}$ of the charge transfer capacitance $C_i$ is connected between the source 5 and the gate G of the transistor T by using a switch $S_{64}^2$.The connection transfers charge from the supply voltage $V_{DD}$ until the voltage of the $C_i$ has become reduced to the value $$U_{Ci}^2=U_T \tag{10}$$

The transferring charge corresponds to the voltage change of the charge transfer capacitance $C_i$ and equals $$\Delta Q=U_S\cdot C_i \tag{11}$$

Figure 7:
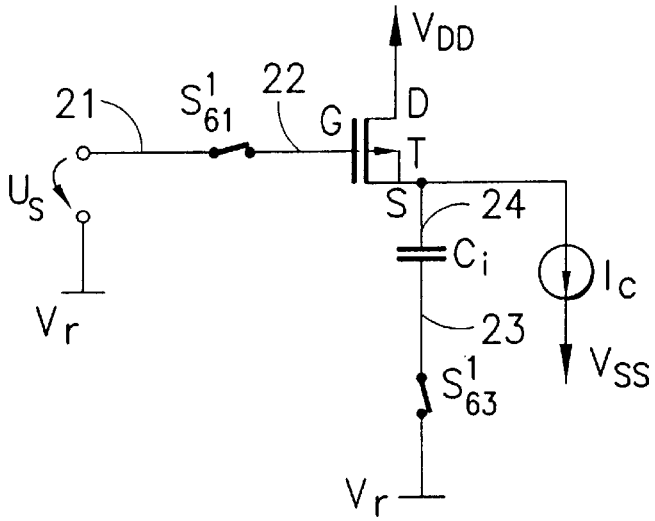
FIG. 7 shows the essential parts connected to the operation during clock phase 1 of the circuit of FIG. 6
Figure 8:
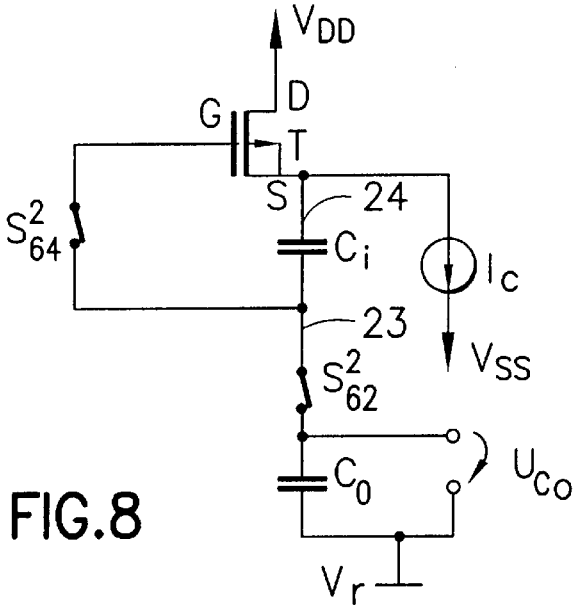
FIG. 8 shows the essential parts connected to the operation during clock phase 2 of the circuit of FIG. 6.

If $U_S>0$, the connection would not operate in the manner described above since the voltage $U_{Ci}$ of the charge transfer capacitance would be lower than the threshold voltage $V_T$ of the transistor T during both clock phases and there would be no current flow during either of the clock phases. To deal with this situation, a constant-current element $I_c$ has been added to the connection. In the following it is assumed that the current $I_c$ of the constant-current element has been chosen such that the connection has time to attain a state of equilibrium during each of the clock phases. As the value of the current of the transistor T reduces or increases to the value $I_c$, current flow to the charge transfer capacitance $C_i$ is terminated and the gate voltage corresponding to the disconnection is obtained from the equations (7) and (8)

$$V_{GSI} = V_T - \frac{I_c}{kV_{DS}} \qquad (V_T < 0) \tag{12}$$

when it is assumed that the transistor operates in a linear, i.e. triode, area. When the transistor operates in a saturation, i.e. pentode, area, the break-off voltage would still be a constant $V_T$. In practice, the non-linearity according to equation (12) is due to the fact that $V_{DS}$ varies the amount of the signal voltage. Since the value of the coefficient k which is characteristic of the transistor is great, the magnitude of the distortion caused by the non-linear term is only a few mV at a one volt signal voltage which means that in the following it can be assumed that the break-off voltage of the current is $V_T$. It is to be noted herein that the transistor shown in FIGS. 6–8 is of the PMOS type. With this kind of transistor $V_T<0$ and the transistor is conducting when $V_{GS}<V_T$.

During clock phase 1, the connection is according to FIG. 7 at which the charge transferring capacitance becomes charged to the voltage $$U_{Ci}^1=U_S-V_T \tag{13}$$

If $U_{Ci}>U_S-V_T$ is valid before the clock phase 1, the constant-current element discharges capacitance $C_i$ until $U_{Ci}$ attains the value of the equation (13) and during this time period, the current of the transistor T is less than $I_c$. During the clock phase, the current of the transistor T settles at the value $I_c$ and it is conducted to the constant-current element $I_c$. Current flowing into the capacitance $C_i$ equals zero when the current of the transistor T has become stable at the value $I_c$.

If before the clock phase 1, $U_{Ci}<U_S-V_T$ is valid, the current of the transistor T increases to be greater than current $I_c$ until the voltage $U_{Ci}$ of the charge transfer capacitance has attained the value according to the equation (13). After this, the current becomes stable at the value $I_c$ and this current flows in its entirety to the constant-current element.

During the clock phase two (FIG. 8), the integrating capacitance $C_O$ is connected in series with the charge transferring capacitance $C_i$ and the voltage $U_{Ci}$ of the charge transferring capacitance, the magnitude of which is equivalent to equation 13, is connected as transistor T controlling voltage between the gate G and the sources of the transistor T. If the voltage of the capacitance $C_i$ equals $U_{Ci}=U_S-V_T<V_T$, the transistor T conducts more current than the value $I_c$ to the constant-current element $I_c$ and to the capacitance $C_i$ until the voltage $U_{Ci}$ settles at the value $V_T$ and the current of the transistor T settles at the value $I_c$. If $U_{Ci}=U_S-V_T>V_T$ is valid, the constant-current element discharges the charge transfer capacitance $C_i$ until its voltage $U_{Ci}$ attains the value $V_T$. During this time, the current of the transistor T is instantaneously smaller than the value $I_c$ at which value it becomes established when charge transfer from the capacitance $C_i$ or to the capacitance $C_i$ has terminated. The charge which has passed through the charge transfer capacitance $C_i$ and which is changing its charging state becomes transferred to the integrating capacitance $C_O$. The magnitude of this charge becoming transferred equals $$\Delta Q=U_S C_i \tag{14}$$

as in the formula 11, i.e. the presented circuit cell operates as an integrator.

Switching elements in the circuit can be controlled by means and circuit solutions which are known per se by a person skilled in the art, depending on which embodiment at which time is being used, and therefore these control elements have been omitted from the figures to make them more descriptive and they have not been described herein in more detail. Also the switching elements can be implemented by means known by a person skilled in the art, for example, by means of semiconductor switches. The constant-current element can be implemented as it is known, for example, by means of a transistor. As an active element in a circuit arrangement according to the invention, instead of MOS transistors, also, for example, other types of transistors can be used. The supply voltages of the circuit are naturally dimensioned on the basis of components and signal voltages which have been used. If "other types of transistors are used,"; the first supply voltage $V_{DD}$ may be positive with respect to the constant potential $V_r$, in that case, the second supply voltage $V_{SS}$ is preferably negative with respect to the constant potential $V_r$.

By means of the present invention, considerable improvements can be achieved over the prior art. When the solution according to the invention is applied, the transistor does not float along with the voltages being processed, in which case the changes in threshold voltages which are due to potential fluctuations are essentially smaller and the operation of the circuit is more linear. Secondly, by means of the solution according to the invention, a faster settling of the circuit at the equilibrium can be achieved since the transistor is continuously in a conducting state. Thus it is possible to use shorter clock phases and process signals which have higher frequencies. Also noise caused by high channel resistance can, to all intents and purposes, be avoided. Additionally, the arrangement according to the invention can be implemented by a smaller amount of switches and by only two clock signals in which case the area the circuit requires can be reduced in size.

Although the solution according to the invention has been previously described for the implementation of an integrating circuit, the present invention is in no way restricted to the implementation of an integrating circuit but the circuit can equally well be used for providing other signal processing operations. As one has presented, for example, in U.S. Pat. No. 5,497,116, a charge transferring circuit connection can easily be converted into an amplifier, a differentiator, a comparing element etc. and it can be used as a basic component for filters, converters, oscillators and other building blocks in electronics.

In particular, the method and signal processing circuit according to the invention can be used in filters, especially in filters which are formed from integrators and which can be implemented by means of the invention as an integrated circuit or as a component of an integrated circuit. A signal processing circuit according to the invention can be implemented so that it is small-sized on silicon and it consumes little power and it has low noise. Thus it is especially suitable for radiophones, for example, in a radio receiver wherein filters formed from it can be used, for example, in an intermediate frequency and an indicator circuit of a receiver. When the invention is used in a radiophone, the control signals of the switches can be formed from the local oscillator frequency of the radiophone, for example, by means of a clock signal generator. The forming of this kind of control signals for switches in a radiophone is known per se for a person skilled in the art and thus it will not be described herein in further detail.

The principle according to the invention can naturally be modified within the frame of the scope specified by the claims, for example, by modification of the details of the implementation and fields of use in manners known by a person skilled in the art.

We claim:

1. A method for processing a signal ($U_S$) wherein in a first phase, a charge transfer capacitance ($C_i$) is switched into an operational connection with the signal ($U_S$), the charge of the charge transfer capacitance ($C_i$) is changed by a charge amount which is proportional to an instantaneous value of the signal ($U_S$) being processed during said first phase, in a second phase, the charge transfer capacitance ($C_i$) is switched into an operational connection with an integrating capacitance ($C_O$), at least a portion of the charge of the charge transfer capacitance ($C_i$) is transferred from the charge transfer capacitance ($C_i$) to said integrating capacitance ($C_O$) during the second phase and the charge of said charge transfer capacitance ($C_i$), established in said first phase, is changed by current formed by an active element (T) connected to the charge transfer capacitance ($C_i$) and this current has been arranged to be dependent on the charge of said charge transfer capacitance ($C_i$), characterized in that said charge transfer from said charge transfer capacitance ($C_i$) to said integrating capacitance ($C_O$) occurs by means of a difference between the currents of the active element (T) and of a constant-current element ($I_c$) connected in series with said active element (T), in such a way that said difference current flows essentially through the charge transfer capacitance ($C_i$) changing said charge by the amount which is proportional to the instantaneous value of the signal ($U_S$).

2. A method according to claim 1, further characterized in that the current of said active element (T) is controlled by said signal ($U_S$).

3. A method according to claim 1, further characterized in that the current of the active element (T) is controlled on the basis of the charge transfer capacitance ($C_i$) and that said current reverts essentially to zero after the charge in said transfer capacitance ($C_i$) has been transferred to the integrating capacitance ($C_O$).

4. A method according to claim 1, further characterized in that the current changing the charge of said charge transfer capacitance ($C_i$) is essentially the difference between the current formed by said active element (T) and the current formed by said constant-current element ($I_c$).

5. A method according to claim 1, further characterized in that the charge change in the charge transfer capacitance ($C_i$), resulting from the charge of said transfer capacitance ($C_i$) being transferred from the charge transfer capacitance ($C_i$) to the integrating capacitance ($C_O$), is proportional to the signal ($U_S$) of the charge transfer capacitance ($C_i$) resulting from said first phase and is opposite in sign.

6. A circuit arrangement for processing a signal ($U_S$) in a first phase and a second phase, said circuit comprising:

a charge transfer capacitance ($C_i$) having first and second poles, an active element (T) connected to said first pole of said charge transfer capacitance ($C_i$), first switching elements ($S_{61}$, $S_{S63}$) for switching, in the first phase, the charge transfer capacitance ($C_i$) into an operational connection with the signal ($U_S$) through said active element (T) for changing a charge of said charge transfer capacitance ($C_i$) by a charge amount which is proportional to an instantaneous value of the signal ($U_S$), an integrating capacitance ($C_O$) switchably connected to said second pole of said charge transfer capacitance ($C_i$), second switching elements ($S_{62}$, $S_{64}$) for switching, in the second phase, the charge transfer capacitance ($C_i$) into an operational connection with said integrating capacitance ($C_O$) for transferring at least a portion of the charge from the charge transfer capacitance ($C_i$) to the integrating capacitance ($C_O$), said active element (T) changing the charge of the charge transfer capacitance ($C_i$) depending on the charge of said charge transfer capacitance ($C_i$), and characterized in that said circuit further comprises:

a constant-current element ($I_c$) for changing the charge of the charge transfer capacitance ($C_i$) in which case said active element (T) and said constant-current element ($I_c$) are connected in series so that a difference between the currents they form flows essentially through the charge transfer capacitance ($C_i$), changing its charge by said amount which is proportional to the instantaneous value of the signal ($U_S$).

7. A circuit arrangement according to claim 6, further characterized in that in the first phase said first switching elements ($S_{61}$, $S_{63}$) have been arranged to switch said signal ($U_S$) to an input (G,S) of said active element (T) to ensure that said difference between the currents formed by the active element (T) and the constant current element ($I_c$) is dependent on the instantaneous value of said signal ($U_S$).

8. A circuit arrangement according to claim 6, further characterized in that in said first phase said first switching elements ($S_{61}$, $S_{63}$) have been arranged to connect the second pole of the charge transfer capacitance ($C_i$) to a constant potential ($V_r$).

9. A circuit arrangement according to claim 8, further characterized in that one pole of said integrating capacitance ($C_O$) is connected to said constant potential ($V_r$).

10. A circuit arrangement according to claim 6, further characterized in that in said second phase said second switching elements ($S_{62}$, $S_{64}$) have been arranged to connect said charge transfer capacitance ($C_i$) and said integrating capacitance ($C_O$) in series for transferring the charge of the charge transfer capacitance ($C_i$), resulting from phase one, between said capacitances ($C_i$, $C_O$).

11. A circuit arrangement according to claim 6, further characterized in that in said second phase, said second switching elements ($S_{62}$, $S_{64}$) have been arranged to connect said charge transfer capacitance ($C_i$) to an input (G, S) of the active element (T) to ensure that the current formed by the active element (T) is dependent on the charge of said charge transfer capacitance ($C_i$).

12. A circuit arrangement according to claim 6, further characterized in that the active element (T) comprises a gate (G), a source (S) and a drain (D) such that the drain (D) of the active element (T) is connected to a first supply voltage ($V_{DD}$), the source (S) of the active element (T) is connected to the first pole of the charge transfer capacitance ($C_i$), and the gate (G) receives signal ($U_S$).

13. A circuit arrangement according to claim 6, further characterized in that said constant-current element ($I_c$) is connected between the first pole of said charge transfer capacitance ($C_i$) and a second supply voltage ($V_{SS}$).

* * * * *